US012005546B2

(12) United States Patent
Saloga et al.

(10) Patent No.: US 12,005,546 B2
(45) Date of Patent: Jun. 11, 2024

(54) SLIDING RING FOR A GRINDING DEVICE AND METHOD FOR PRODUCING THE SLIDING RING

(71) Applicant: MENZER GmbH, Taucha (DE)

(72) Inventors: André Saloga, Leipzig (DE); Werner Starke, Leipzig (DE); Torsten Ceranski, Leipzig (DE)

(73) Assignee: MENZER GmbH, Taucha (DE)

( * ) Notice: Subject to any disclaimer, the term of this patent is extended or adjusted under 35 U.S.C. 154(b) by 395 days.

(21) Appl. No.: 16/965,065

(22) PCT Filed: Jan. 29, 2019

(86) PCT No.: PCT/EP2019/052112
§ 371 (c)(1),
(2) Date: Jul. 27, 2020

(87) PCT Pub. No.: WO2019/145559
PCT Pub. Date: Aug. 1, 2019

(65) Prior Publication Data

US 2021/0016418 A1 Jan. 21, 2021

(30) Foreign Application Priority Data

Jan. 29, 2018 (DE) ..... 10 2018 000 670.1
Jan. 29, 2018 (DE) ..... 20 2018 000 435.9

(51) Int. Cl.
*B24B 55/10* (2006.01)
*B24B 55/05* (2006.01)
*B24B 7/18* (2006.01)

(52) U.S. Cl.
CPC ..... *B24B 55/102* (2013.01); *B24B 55/05* (2013.01); *B24B 7/184* (2013.01)

(58) Field of Classification Search
CPC ..... B24B 55/04; B24B 55/06; B24B 55/05; B24B 55/055; B24B 55/10; B24B 55/102; B24B 55/105; B24B 55/045
See application file for complete search history.

(56) References Cited

U.S. PATENT DOCUMENTS 5,653,561 A * 8/1997 May ..... B23Q 11/0046 408/72 R
8,622,788 B2 * 1/2014 Eto ..... B24B 55/05 451/451

(Continued)

FOREIGN PATENT DOCUMENTS

CN 101985208 A * 3/2011 ..... B24B 37/04
DE 877080 A * 9/1961

(Continued)

OTHER PUBLICATIONS

Translation of DE4322284.pdf (Year: 2023).*
International Search Report under International Patent Application No. PCT/EP2019/052112, dated May 7, 2019.

*Primary Examiner* — Eric J Rosen
*Assistant Examiner* — Robert C Moore
(74) *Attorney, Agent, or Firm* — Howard IP Law Group

(57) ABSTRACT

A sliding ring for a grinding device consisting of a grinding element and a hood covering the grinding element and a sliding ring attachable to the side of the hood facing a surface to be machined, the sliding ring having a sliding surface provided for sliding on the surface to be machined, the sliding ring consisting of at least one elastic component and a sliding component, the sliding surface being formed on the sliding component and the elastic component being arranged on the side of the sliding component opposite the sliding surface.

16 Claims, 9 Drawing Sheets

(56) References Cited

U.S. PATENT DOCUMENTS

| | | | | |
|---|---|---|---|---|
| 2012/0184192 | A1 | 7/2012 | Kawamata et al. | |
| 2013/0196573 | A1* | 8/2013 | Fukushima | B24B 37/04 451/36 |
| 2016/0213216 | A1* | 7/2016 | Laessig | B24B 55/102 |

FOREIGN PATENT DOCUMENTS

| | | | | |
|---|---|---|---|---|
| DE | 4322284 | A1 * | 1/1995 | B23Q 11/0866 |
| DE | 4322284 | A1 | 1/1995 | |
| DE | 202005011659 | U1 | 11/2005 | |
| DE | 202005011659 | U1 * | 12/2005 | B24B 55/10 |
| DE | 102009044554 | A1 | 4/2011 | |
| DE | 202015000409 | U1 | 3/2015 | |
| EP | 1925399 | A2 | 5/2008 | |
| GB | 877080 | | 9/1961 | |
| JP | 2006007403 | A | 1/2006 | |
| WO | 2008033377 | A2 | 3/2008 | |
| WO | WO-2008033377 | A2 * | 3/2008 | B24B 23/02 |
| WO | 2010087072 | A1 | 8/2010 | |

* cited by examiner

SLIDING RING FOR A GRINDING DEVICE AND METHOD FOR PRODUCING THE SLIDING RING

CROSS-REFERENCE TO RELATED APPLICATIONS

This application is the national stage application under 35 U.S.C. § 371 of International Application No. PCT/EP2019/052112 filed on 29 Jan. 2019, which claims priority to DE 102018000670.1 filed 29 Jan. 2018, and DE 202018000435.9 filed 29 Jan. 2018 the entire disclosures of which are incorporated herein by reference in their entireties.

FIELD OF INVENTION

The invention relates to a sliding ring for a grinding device with a grinding element and a hood covering the grinding element, wherein the sliding ring is intended to be attached to the side of the hood facing a surface to be machined. The invention further relates to such a grinding device and a method for producing such a sliding ring.

BACKGROUND

Grinding devices have a grinding element with grinding material on at least one surface, wherein the grinding element is movably arranged in a head of the grinding device. The grinding element is often referred to as a wear plate, grinding plate or grinding shoe and can perform rotating or eccentric movements. So-called drywall grinders are used in particular in the construction industry, but also in the private sector, wherein the head is swivel-mounted on a bracket. In order to reduce the emission of dust, the head of many grinding devices is equipped with a hood or cover, which has a connection for a suction device, so that the grinding dust produced can be sucked out from inside the hood by means of the suction device during operation of the grinding device. The suction device can also be used to generate a vacuum, which causes the head to adhere to a surface to be ground. This is particularly advantageous when working on ceilings or large wall surfaces where the user of the grinder no longer has to bear the entire weight of the grinder due to the adhesion.

Such a grinder is known for example from DE 20 2005 011 659 U1. In order to achieve a good tightness of the hood with respect to the environment and at the same time an easy sliding of the grinding device over the surface to be machined, the grinding device described herein has a sliding ring which is attached to the edge of the hood facing the surface to be machined and then slid over the surface to be machined and largely or completely closes the gap between the hood and the surface to be machined. The hood, and thus also the sliding ring, and the grinding element can be adjusted relative to one another, so that the front edge of the sliding ring and the front of the grinding element can be brought into an aligned position. The sliding ring is made of a slidable, solid and rigid material so that it remains dimensionally stable when working with the grinder. As a result, however, the tightness of the hood can no longer be guaranteed in the event of unevenness in the surface to be ground, such that the negative pressure and the resulting holding force of the grinding device on the surface to be machined is reduced. This often leads to the grinder falling off the surface to be machined.

From DE 20 2015 000 409 U1, a grinding device of a similar design is known, but which has an elastic sealing profile that extends around the entire circumference of the hood. The sealing profile is preferably designed as a silicone lip. This ensures that the hood is sealed even on an uneven surface. However, the sealing or silicone rings described here have only insufficient sliding properties. In order to make it possible for the suction hood to slide on the surface to be machined or to avoid it being suctioned tightly, the vacuum in the suction hood must not be too high. However, this negative pressure is insufficient to bring about a holding force which, particularly when working overhead, not only partially, but completely holds the weight of the head of the grinding machine on the surface to be ground.

Conventional sealing and sliding rings for suction hoods do not have high sliding properties in connection with a sufficiently pronounced elasticity to ensure a constant airtight seal of the suction hood on uneven surfaces to be ground. However, this tight seal is necessary so that grinding devices with extraction hoods reliably hold their own weight on the surface to be machined even when working on uneven surfaces, in order to make the user's work significantly easier.

SUMMARY

It is therefore an object of the present invention to provide a sliding ring and a grinding device with such a sliding ring, wherein the disadvantages of the prior art can be avoided or reduced. In addition, a method for producing such a sliding ring is to be provided.

This object is achieved by a sliding ring, a grinding device and a method for producing the sliding ring according to the independent claims. Advantageous further developments and preferred embodiments can be found in the dependent claims and the description below.

The sliding ring according to the invention for a grinding device with a grinding element and a hood covering the grinding element, also called a drive plate cover, drive plate housing or grinding head cover, can be attached to the side of the hood facing a surface to be machined. The sliding ring has a sliding surface provided for sliding on the surface to be machined. The sliding ring has at least one elastic component and a sliding component, the sliding surface being arranged on the sliding component and the elastic component being arranged on the side of the sliding component opposite the sliding surface. The sliding component guarantees the sliding of the sliding ring or the grinding device over the surface to be machined, despite the forces acting on the sliding ring and sealing the sliding ring due to the negative pressure. This is achieved through favorable friction values, i.e. the static and sliding friction coefficients, of the sliding component. The elastic component is elastically deformable and is used to adapt the seal ring to the existing unevenness of the surface to be machined. In the case of assembly, i.e. when the sliding ring is mounted on the hood, the sliding component is arranged at least on the side of the sliding ring facing the surface to be machined.

The advantage of the sliding ring according to the invention is its pronounced lubricity in connection with its property of reliably sealing the hood against the entry of undesired false air. A relatively constant negative pressure can thereby be ensured in the interior of the suction hood, which in turn brings about a stable holding force which then reliably holds the grinding device or its head against the surface to be ground.

The elastic component as well as the sliding component are preferably in combination (i.e. together) locally elastically deformable, so that the shape of the seal ring adapts itself locally and flexibly to the surface to be machined. This ensures that the hood is watertight even on a surface that is not completely level, so that a stable suction effect can be guaranteed that is large enough at all times to allow the weight of the grinder to be applied to the surface to be machined, e.g. on the ceiling of a room. Thanks to the improved sealing of the hood, lower reserves of the suction forces generated by the suction device during operation of the grinding machine are also required. As a result, the sliding ring is pressed less strongly against the surface to be ground, which results in significantly better sliding behavior, i.e. the user of the grinding device has to apply less force to move the grinding device back and forth on the surface to be machined. In addition, due to the stabilization of the suction effect, a lower degree of concentration on the part of the user of the grinding device and less control effort for controlling external air are necessary than in prior art.

The elastic component preferably has an elastically deformable material, such as rubber, an elastomer or foam, in particular and preferably a foam made of rubber-elastic material, preferably plastic, and in particular and preferably consists of an elastically deformable material, such as rubber, an elastomer or foam, in particular and preferably a foam made of rubber-elastic material, preferably plastic, or contains one or more resilient component(s), which may for example be made of plastic or metal.

In a preferred embodiment, the elastic component and/or the sliding component or an assembly formed from the elastic component and a sliding component directly adjacent to the elastic component has a compression hardness of less than 120 kPa, particularly preferably less than 100 kPa and particularly preferably less than 80 kPa. In a preferred embodiment, the elastic component and/or the sliding component or an assembly formed from the elastic component and a sliding component directly adjacent to the elastic component has an elastic component of less than 11,000 MPa, particularly preferably less than 10,000 MPa and particularly preferably less than 9,000 MPa.

In a particular embodiment, the sliding ring furthermore has a hard component. This can serve as an abutment for the elastic component if it is elastically deformed. When mounted, the hard component is arranged on the side of the sliding ring facing the hood, i.e. on the side of the elastic component facing away from the surface to be machined.

If the sliding ring has no hard component, part of the hood can serve as an abutment for the elastic component.

In one embodiment, the elastic component is enclosed by the sliding component or the sliding component and the hard component only on part of its outside, i.e. along its circumference in a cross section through the sliding ring. This means that the sliding component is arranged, for example, only when mounted on the surface of the elastic component opposite the surface to be machined, but not on the side of the elastic component. It is also possible to arrange the sliding component on the surface of the elastic component opposite the surface to be machined and on a partial region of the side surfaces of the elastic component, with the two partial regions respectively adjoining the surface of the elastic component opposite the surface to be machined.

Preferably, however, the elastic component is completely enclosed by the sliding component or the sliding component and the hard component. Since the sliding component or the sliding component and the hard component thus form a closed space inside or between them, the elastic component can, in addition to the above-mentioned embodiments, also be a gas, a liquid, a gel or a large number of solid particles or a combination of both. However, the elastic component particularly preferably has no gas.

The sliding component is preferably a region of the surface of the elastic component that is changed compared to the base material of the elastic component, or a coating of the elastic component with a lubricious material or a lubricious film, or is characterized by a plurality of small, and in each case non-deformable, elements made of a lubricious material. A modified surface area, a coating or an embodiment using a plurality of non-deformable elements is only possible with a fixed version of the elastic component using an elastically deformable material or a resilient component, while the implementation of the sliding component as a sliding film can be implemented at any time. The lubricious film within the meaning of the application comprises both films consisting entirely of a sliding material and films whose surface facing the surface to be machined (the sliding surface) is coated with a lubricious material.

Lubricious materials that can be used to form the sliding component or parts of the sliding component are, for example, polyethylene (PE), particularly preferably ultra-high molecular weight polyethylene (PE-UHMW) or polytetrafluoroethylene (PTFE), polyolefin, graphite, polypropylene (PP) or polyamide (PA).

A modified surface area of the elastic component can be, for example, the outer coating formed in the manufacturing process of a polyethylene foam used as the elastic component.

In a preferred embodiment, the sliding component is made of a different material than the elastic component.

The sliding surface of the sliding component particularly preferably has a dynamic friction coefficient of less than 0.5, particularly preferably less than 0.4, particularly preferably less than 0.35, particularly preferably less than or equal to 0.3. The sliding surface of the sliding component particularly preferably has a dynamic friction coefficient of more than 0.05, particularly preferably of more than 0.1, particularly preferably of more than or equal to 0.15. The dynamic coefficient of friction is particularly preferably determined according to the test standard ISO (IEC) 7148-2 or according to the test standard ASTM D 3702. The dynamic coefficient of friction is particularly preferably determined using pin-disc testing equipment with a test setup based on the requirements of ISO 7148-2. For this purpose, a pin with a diameter of 6 mm made of the material to be tested is pressed at 3 MPa onto a rotating C35 steel disc, with a diameter of 160 mm, and a roughness of Ra=0.7-0.9 μm. The disc runs at a speed of 0.33 m/s over a distance of 28,000 meters. The dynamic sliding friction coefficient is determined from the average values of three test specimens between 10 and 28 km running distance.

In a preferred embodiment, the sliding component has a thickness of less than 1 mm, particularly preferably less than 0.5 mm, particularly preferably less than 0.35 mm, particularly preferably less than 0.1 mm, particularly preferably less than 0.05 mm. The sliding component can be, for example, a PTFE coating on the elastic component with a layer thickness of 0.01 to 0.04 mm. The sliding component can, for example, also be made of PE and have a layer thickness of 0.1 to 0.3 mm.

In a particularly preferred embodiment, the sliding ring has a hard component, which is a ring made of a rigid plastic, while the elastic component is an annular layer made of a polyurethane foam and the sliding component is a polyethylene film, wherein the hard component and the sliding component completely or partially enclose the elastic component.

The sliding ring preferably has a component which can form part of a releasable connection of the sliding ring to a hood of a grinding device. This ensures the interchangeability of the sliding ring, which is required, for example, due to wear of the sliding component or the elastic component, or the replacement of the sliding ring according to the invention by other components, for example a brush ring, in applications in which the other component is more suitable. Such components are, for example, snap hooks, Velcro fasteners, detachable adhesive connections, magnetic, clamping, screw or plug connections or the corresponding counterparts to those components if they are arranged in the hood of the grinding device. For example, the sliding ring can have undercuts in the hard component for latching snap hooks, which are formed on the hood. In order to connect the sliding ring to the hood, the sliding ring component interacts with the corresponding components or elements of the hood of the grinding device.

In a further preferred embodiment, openings are arranged in the hard component for the passage of air into the interior of the sliding ring and thus, in the assembled state, into the interior of a hood of a grinding device. False air openings and/or control valves for regulating the supply of false air in the hood of the grinding device can thus be at least partially saved. The openings are preferably evenly distributed over the circumference of the sliding ring.

The sliding ring preferably forms a continuous ring. In another preferred embodiment, the sliding ring has at least two ring segments that are independent of one another or releasably connected to one another. For example, a ring segment can represent a quarter of the ring circumference of the sliding ring, while a second ring segment represents three quarters of the ring circumference. This embodiment enables, particularly in the case of a similarly divided hood of a grinding device, the grinding of the surface to be machined close to the edge, for example, in the edge regions or corners of a ceiling where the ceiling abuts a side wall, or in areas in which the ceiling or elements protruding from a wall, for example, stucco decorations, are arranged.

The sliding surface of the sliding ring according to the invention is particularly preferably ring-shaped. The sliding surface can be made circular. However, other ring-shaped geometries for the sliding surface are also conceivable, for example triangular or elliptical rings.

In a preferred embodiment, the sliding surface is flat or crowned.

In a preferred embodiment, the thickness of the sliding component of the sliding ring measured in the direction normal to the sliding surface is smaller than the thickness of the elastic component measured in the same direction. The thickness of the elastic component of the sliding ring measured in the direction normal to the sliding surface is particularly preferably more than a factor of 2, particularly preferably more than a factor 5, particularly preferably more than a factor 10, particularly preferably more than a factor 15, particularly preferably more than a factor of 20, particularly preferably more than a factor of 25, particularly preferably more than a factor of 30 thicker than the thickness of the sliding component measured in the same direction.

The sliding ring according to the invention is preferably used on a grinding device which has a grinding element and a hood covering the grinding element, the sliding ring being arranged on the side of the hood facing a surface to be machined. A grinding device is understood to mean any form of grinding or polishing device in which a cutting tool element is covered with a hood and which is guided over a surface to be machined, a negative pressure being generated in the hood, which brings about a stable holding force which the grinder or its head then reliably holds the surface to be machined.

A grinding device according to the invention has a grinding element, a hood covering the grinding element and a sliding ring according to the invention arranged on the side of the hood facing a surface to be machined. In addition, a connection for a suction device is formed in the hood, the suction device being suitable for extracting air and grinding dust from the interior of the hood during operation of the grinding device.

The hood preferably has a first region which contains a part of the circumference of the side facing a surface to be machined and can be detached from other regions of the hood, the sliding ring having at least two ring segments which are independent of one another or releasably connected to one another, as described above. A ring segment of the sliding ring is arranged on the first area of the hood, wherein the length of the first area of the hood and the length of the ring segment of the sliding ring arranged on the first area are the same. This makes it particularly easy to grind the surface to be machined close to the edge.

The method according to the invention for producing an embodiment of the sliding ring according to the invention, in which the sliding component is a film, has the steps described below. First, a slidable film is inserted into a mold, the mold having an interior, the edge of which is at least partially covered by the film after it has been inserted. In a special embodiment, a ring or a segment of a ring made of a rigid material is also inserted. Then, an elastic material or a starting material made of an elastic material is inserted into the interior of the mold and—in the special embodiment—in an intermediate space between the film and the ring or the segment of a ring or introduced between the film and the ring or the segment of a ring through one or more openings in the mold and/or the film and/or—in the special embodiment—in the ring or the segment of a ring. The elastic material can be, for example, a gas, a liquid, a gel or solid particles, particularly preferably a plurality of solid particles or a combination thereof. In this case, the film or—in the special embodiment—the film and the ring or the segment of a ring form a complete or partial covering of the elastic material. Furthermore, the elastic material can be rubber or foam, in which case a liquid or gaseous starting material of the rubber or foam is introduced, which is subsequently treated thermally or otherwise, so that the elastic material is formed inside the mold or in the space between the film and the ring or segment of a ring. If the elastic material is, for example, foam, the starting material is a foamable material which is foamed during or after its introduction, thereby producing a foam (foam-like material). In the case of a slightly leaking elastic material, the film and the rigid plastic carrier can be connected to the elastic component before filling, for example by welding or gluing. Here again one or more openings can be closed with a material in such a way that the elastic material is prevented from escaping from the sliding ring even under pressure. However, this step can also be omitted if the elastic material is a solid material which does not emerge through one or more of the openings even under pressure. Thus, there is a composite component made of the slidable film and the elastic material or—in the special embodiment—from the ring or the segment of a ring, the slidable film and the elastic material arranged between them.

Finally, areas of the film that protrude beyond the sliding ring can be optionally removed.

If the sliding ring is manufactured as a whole using this method, the sliding ring can then be removed using a separating step, such as cutting, sawing or laser cutting, and can then still be divided into several ring segments. Of course, this is only possible for sliding rings in which the elastic component consists of a solid material. In the case of other materials, such as gases, liquids, gels or solid particles or combinations thereof, the ring segments are produced separately using the described method and then assembled to form the sliding ring.

A ring or a segment of a ring made of a rigid plastic is preferably used, while the film consists of polyethylene and the starting material of the elastic material contains polyurethane and a blowing agent.

BRIEF DESCRIPTION OF DRAWINGS

The invention is further clarified below using exemplary embodiments and figures. The dimensions of the individual elements and their relationship to one another are not reproduced to scale, but only schematically. The same reference numbers designate corresponding components of the same type.

FIGURES

Figure 1:
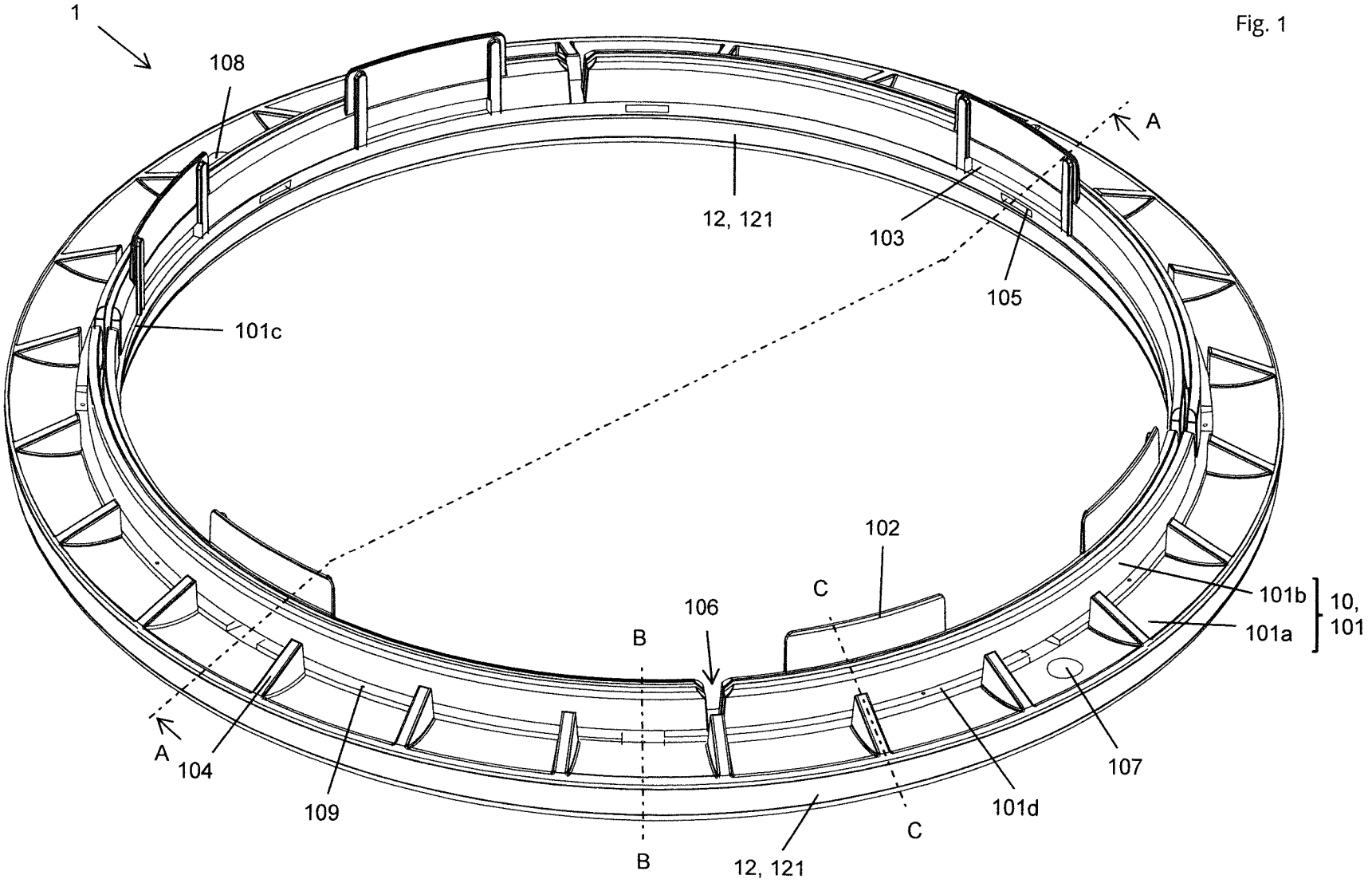
Figure 2:
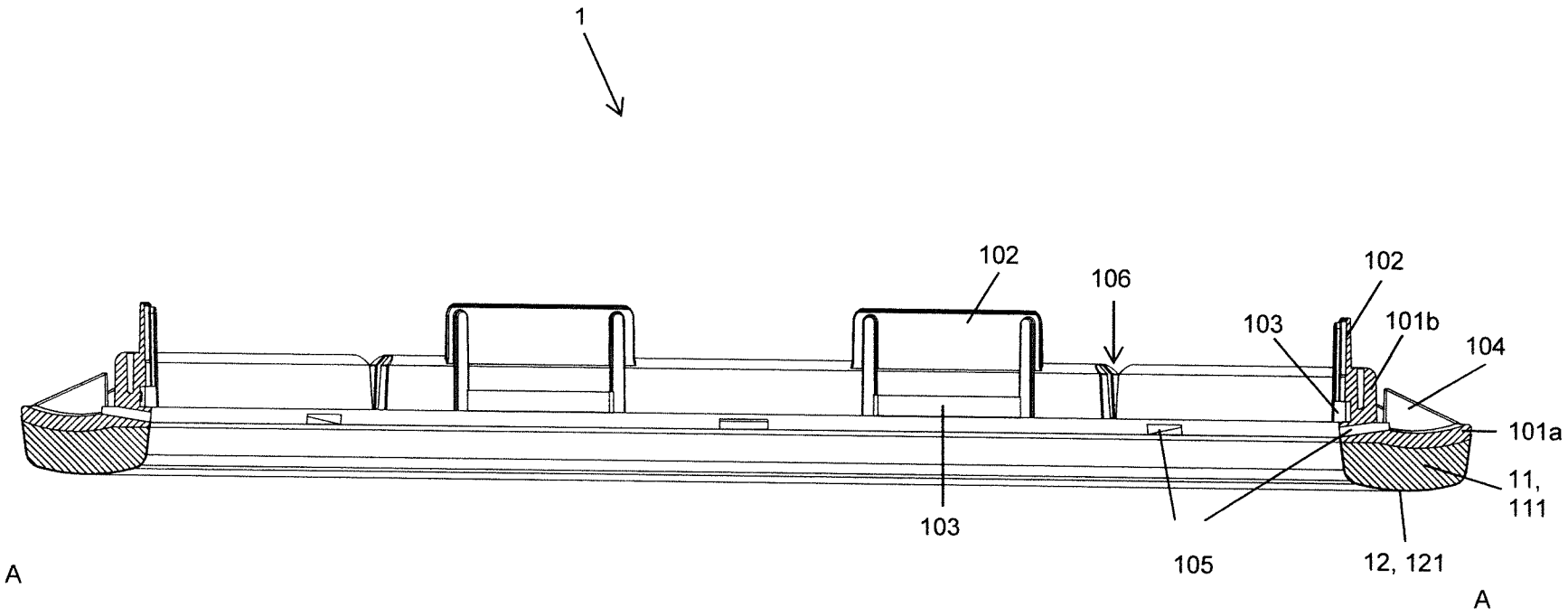
Figure 3:
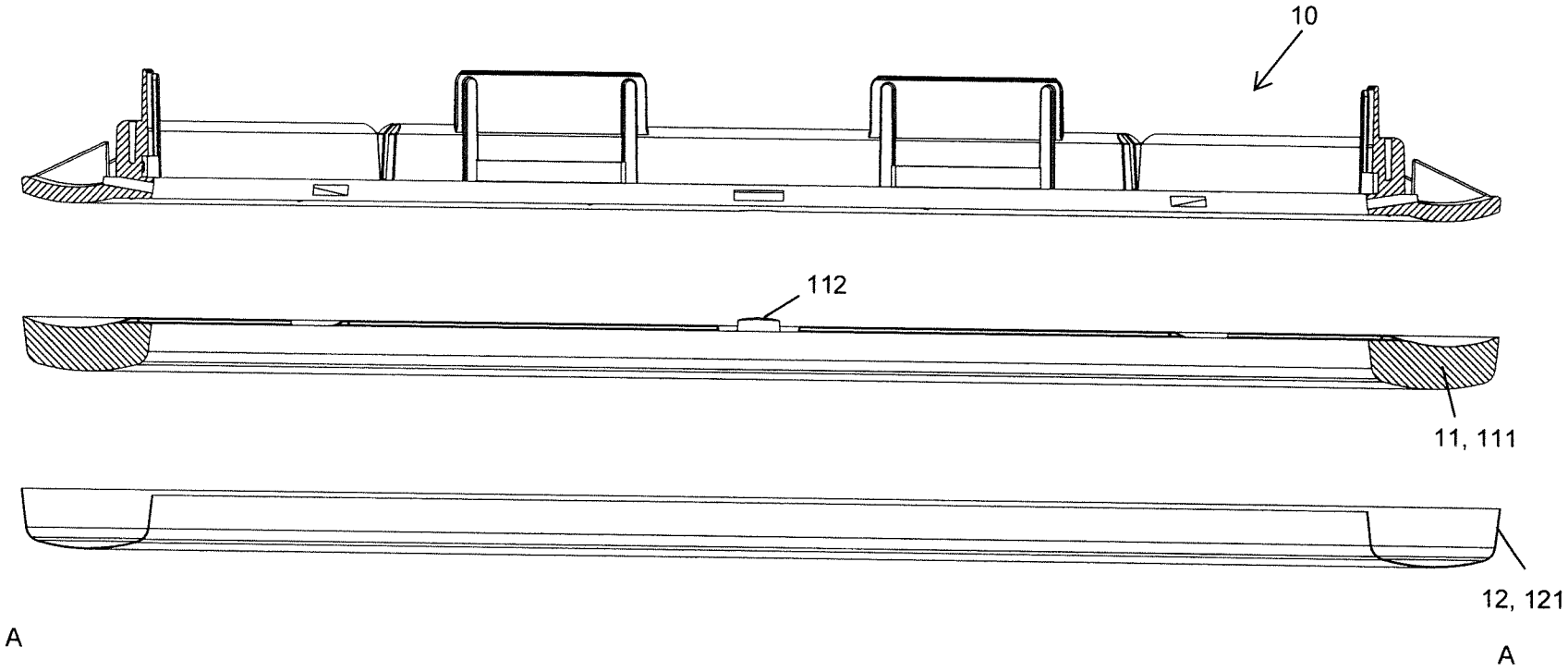
Figure 4A:
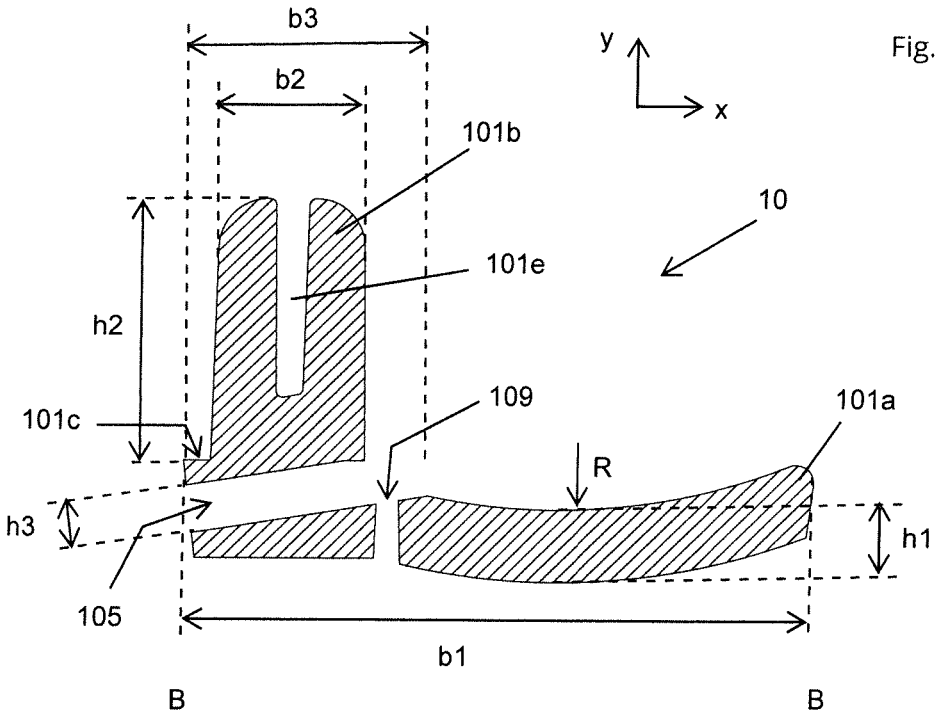
Figure 4B:
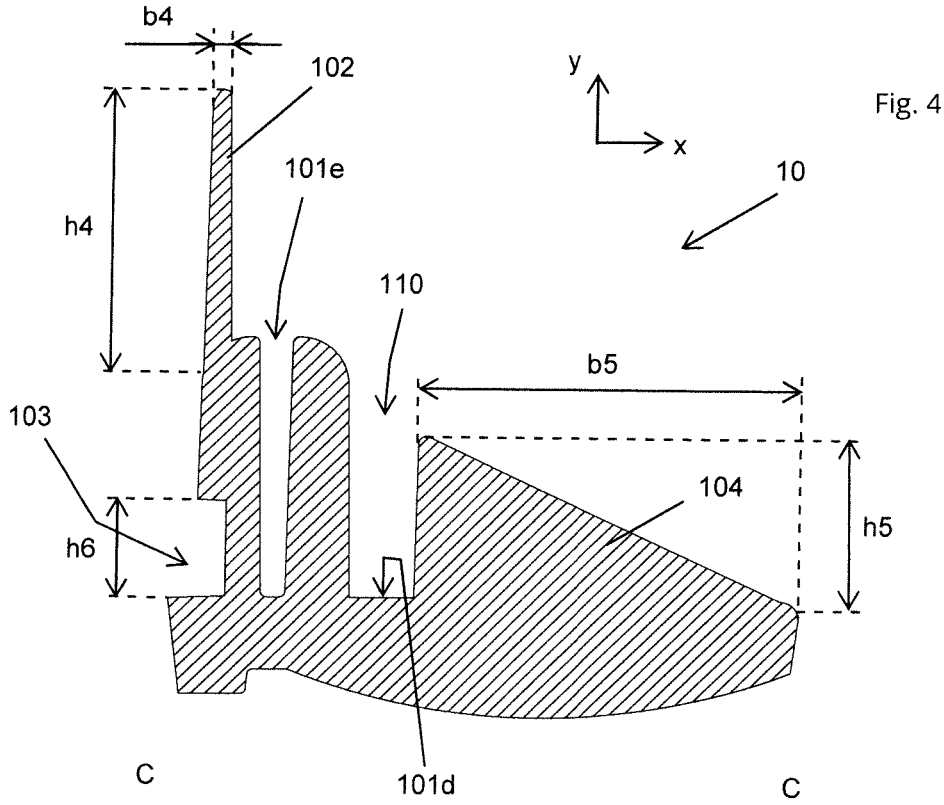
Figure 5A:
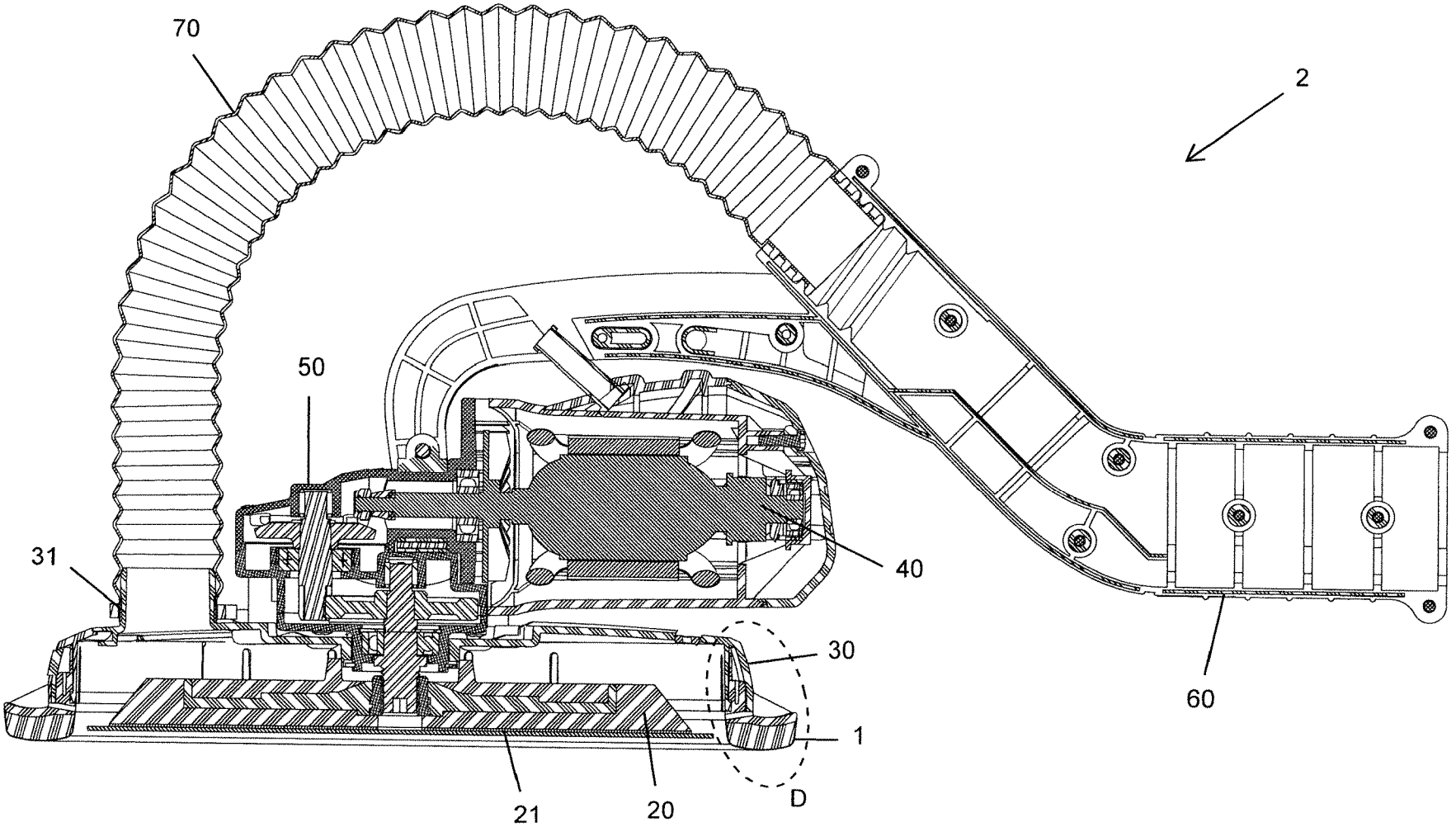
Figure 5B:
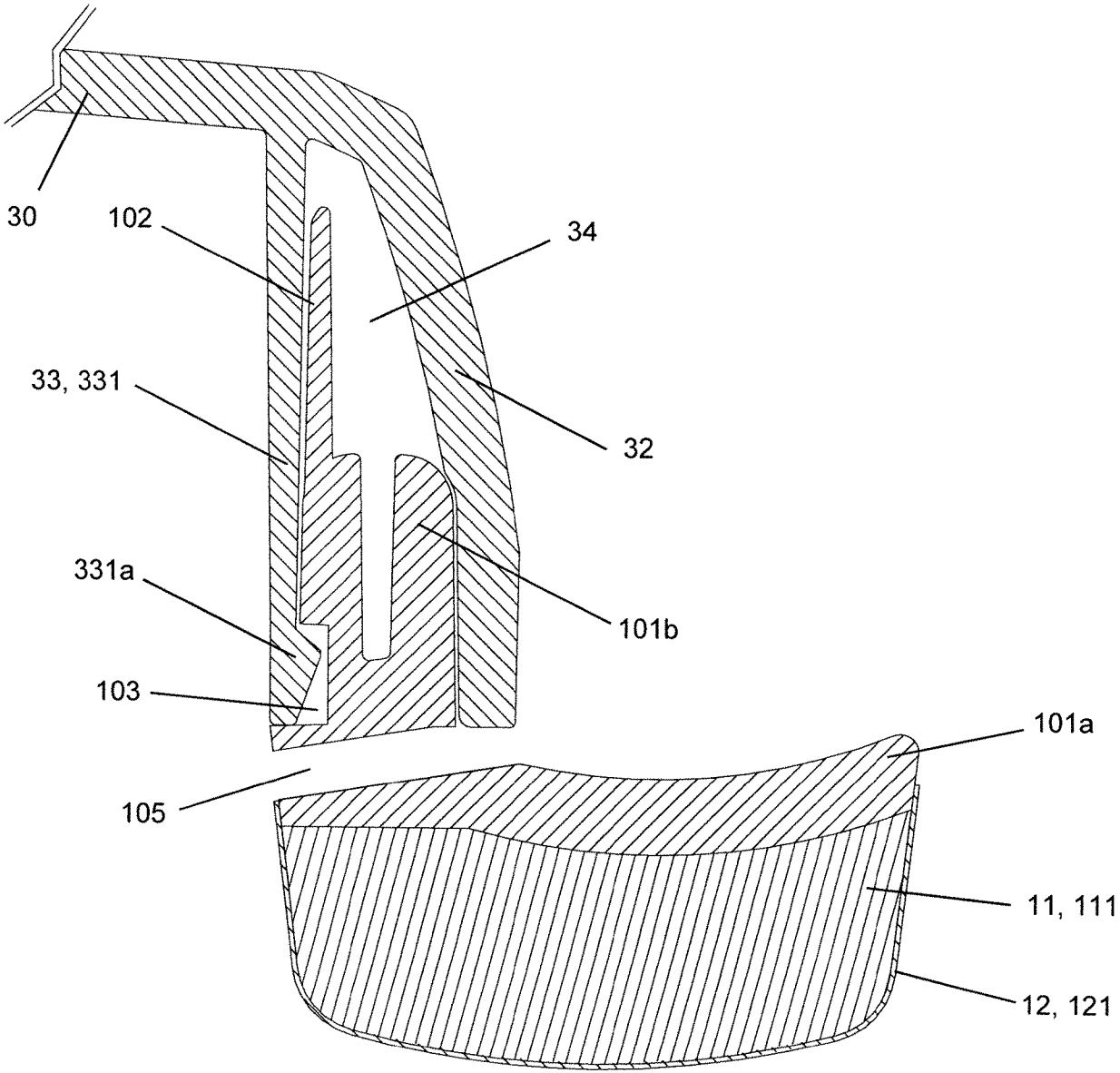
Figure 6:
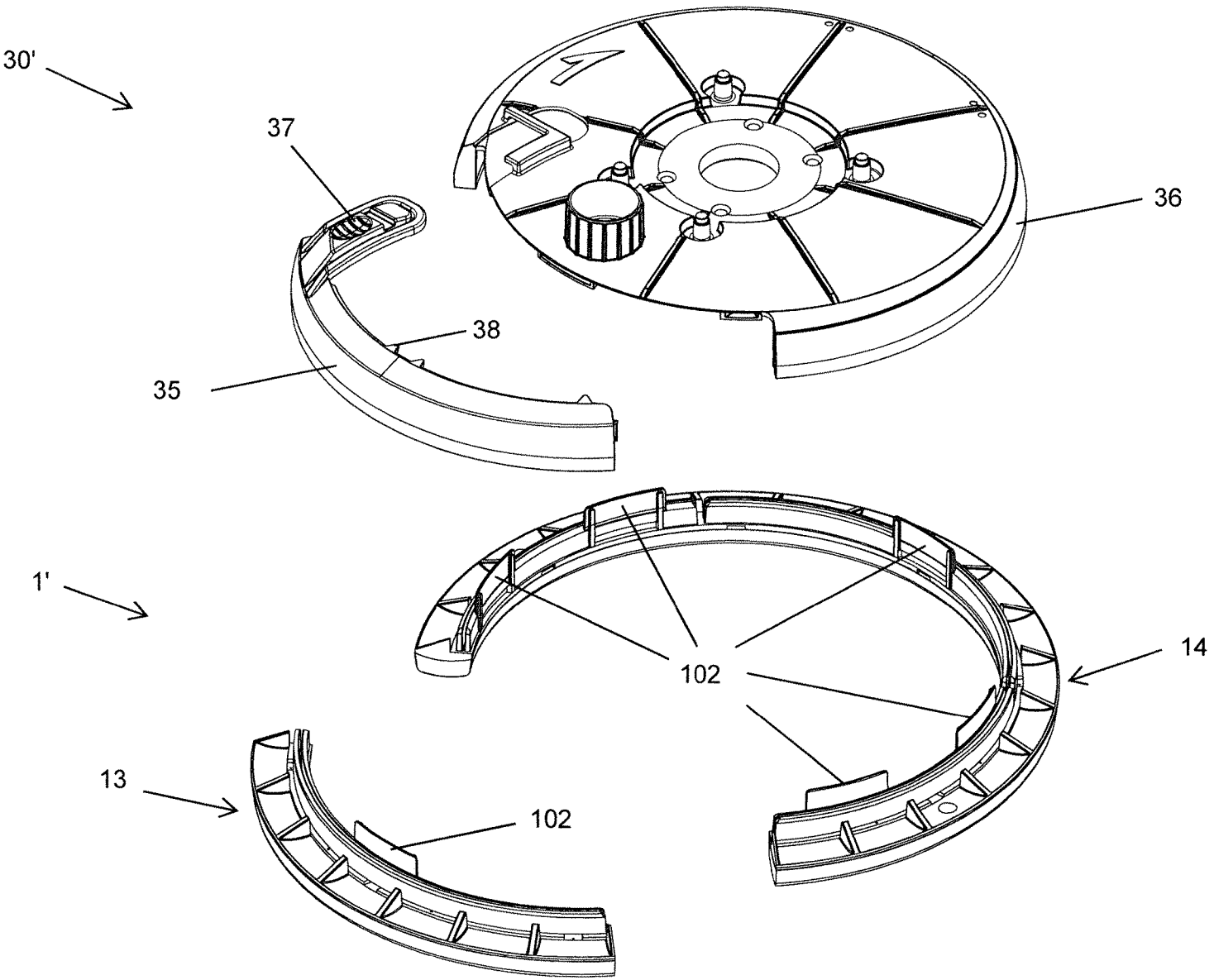
Figure 7:
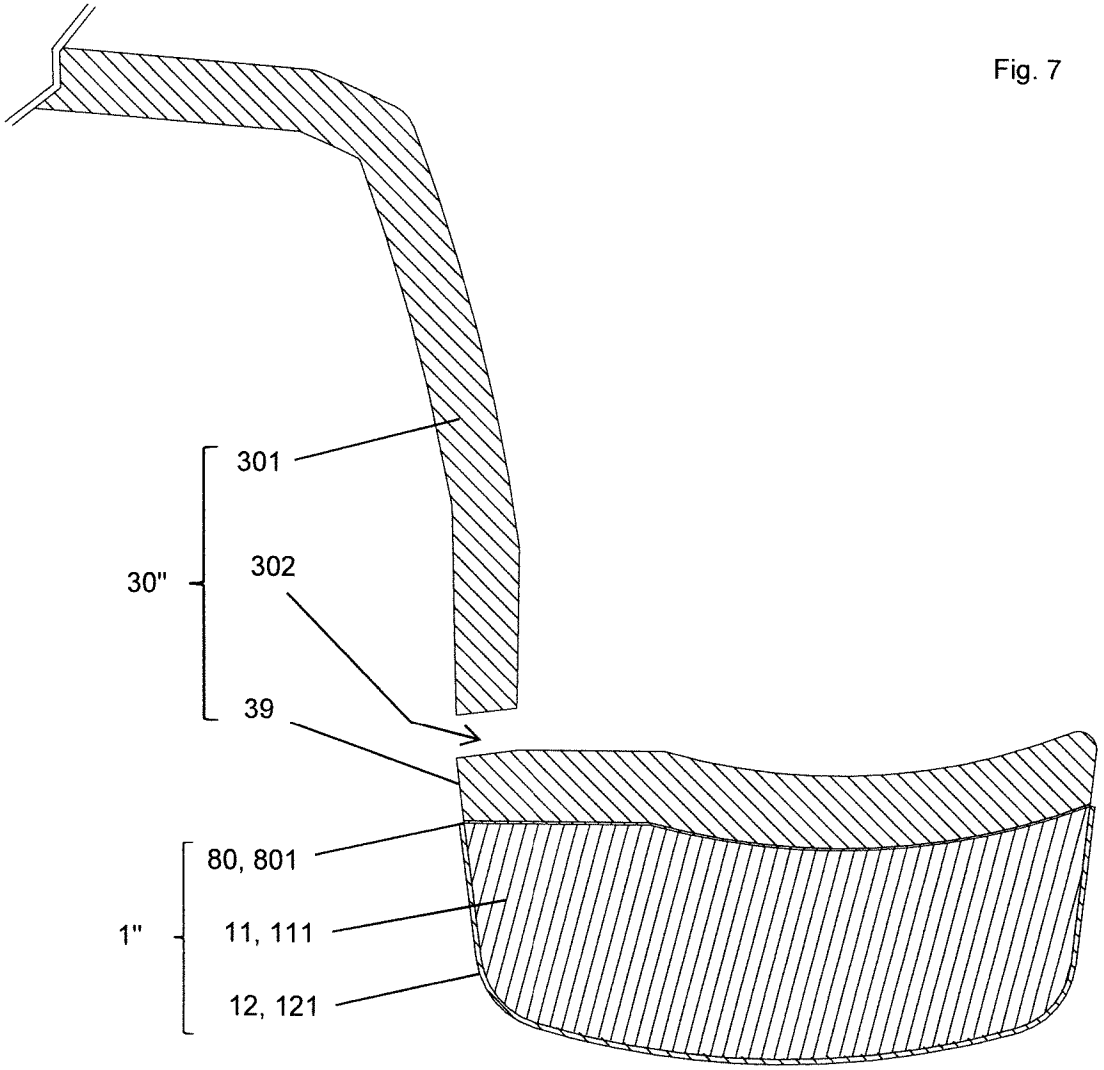
Figure 8:
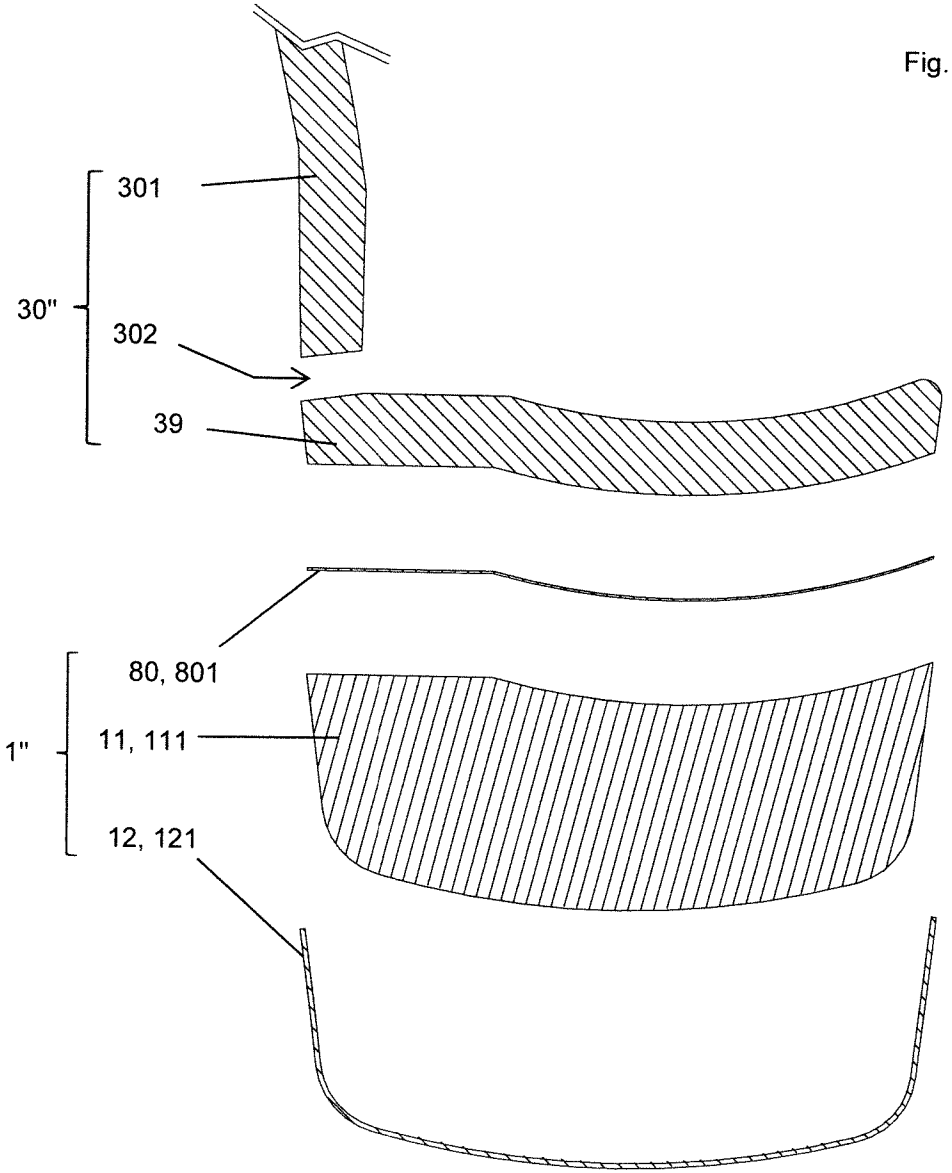

FIG. 1 shows a perspective illustration of a first embodiment of a sliding ring according to the invention, FIG. 2 shows a plan view of a cross section along the line AA through the sliding ring of FIG. 1, FIG. 3 shows an exploded view of FIG. 2 to illustrate the individual components of the sliding ring, FIG. 4A shows a cross section through the hard component of the sliding ring from FIG. 1 along line B-B, FIG. 4B shows a cross section through the hard component of the sliding ring from FIG. 1 along line CC, FIG. 5A shows a first embodiment of a grinding device according to the invention with a sliding ring in a cross section, FIG. 5B provides a detailed view of FIG. 5A, FIG. 6 shows perspective views of a split hood and a second embodiment of the sliding ring according to the invention, in which the sliding ring is split, FIG. 7 shows a section of a cross section through a region of a further embodiment of a grinding device according to the invention with a third embodiment of the sliding ring according to the invention and FIG. 8 shows an exploded view of FIG. 7 to illustrate a hood of the grinding device and the third embodiment of the sliding ring according to the invention.

DETAILED DESCRIPTION

FIG. 1 shows a perspective view of a first embodiment 1 of a sliding ring according to the invention, the sliding ring 1 being a continuous ring and not consisting of several ring segments. FIG. 2 is a plan view of a cross section through the sliding ring 1 along the line AA shown in FIG. 1, while FIG. 3 shows the individual components of the sliding ring 1 of FIG. 2 in an exploded view. FIGS. 4A and 4B show details of the hard component of the sliding ring 1 in detailed representations of cross sections along section lines BB and CC as shown in FIG. 1.

The sliding ring 1 consists of a hard component 10, an elastic component 11, which cannot be seen in the illustration in FIG. 1, and a sliding component 12. In the exemplary embodiment shown, the hard component 10 consists of plastic with the designation PA6 GF 30 (polyamide 6 with 30% glass fiber content) and has a ring 101, which in turn contains a first region 101*a* and a second region 101*b*. In an installed state, i.e. when the sliding ring 1 is attached to a hood of a grinding device, the first region 101*a* extends essentially parallel to a surface that is to be machined with the grinding device. The second region 101*b* of the ring 101 extends essentially perpendicular to the surface to be machined with the grinding device and serves to fasten the slide ring 1 to the hood. It adjoins the top of the first region 101*a* and is located on the inner side of the ring 101. In the exemplary embodiment shown, both areas are formed in one piece, that is to say they are produced together in one production step and in a connected state. In the installed state, a large part of the second region 101*b* is essentially in a space between an inner wall of the hood and an outer wall of the hood. This is explained in more detail with reference to FIGS. 5A and 5B. The second region 101*b* also has a first contact surface 101*c* on which the inner wall of the hood rests in the assembled state and a second contact surface 101*d* on which the outer wall of the hood rests in the assembled state.

The ring 101 is essentially uniform over its entire course, but has special features at some points, which will be discussed in more detail below.

In the example shown, six hood elements 102 are arranged along the circumferential line of the ring 101. Of course, the number of hood elements can also be larger, for example eight, or smaller. These extend the second section 101*b* upwards, i.e. towards the hood, and are used to cover openings formed in the inner wall of the hood to separate a section formed in the inner wall of the hood from adjacent sections of the inner wall of the hood towards the interspace by means of a hook. In this way, the hood elements 102 are always arranged at the points on the ring 101 where an undercut 103 is also formed in each case to accommodate the hook formed in the inner wall of the hood in the second area 101*b* of the ring. Thus the undercuts 103 form means for the detachable connection of the seal ring 1 to a hood of a grinder, corresponding to the means located on the hood of the grinder, the aforementioned hooks.

In addition, reinforcing ribs 104 are formed on the upper side of the first region 101*a*, which serve to increase the rigidity of the first region 101*a* when pressure forces are applied to the underside of the sliding ring 1. The reinforcing ribs 104 are formed in one piece with the ring 101 in the exemplary embodiment shown. Of course, the number of reinforcing ribs can also be larger or smaller.

In the ring 101, eight openings 105 to the outside air inlet are furthermore formed, which extend from an outer side of the second region 101*b* and the upper side of the first region 101*a* to an inner side of the ring 101 and, in the case shown, are cuboidal. Of course, the number of openings to the outside air inlet can also be larger or smaller. Through these openings 105, air flows into the interior of the hood during operation of the grinding device, so that the dust produced during grinding can be extracted by means of a suction device. In areas of the ring 101 in which the openings 105 for the external air intake are formed, the second bearing surface 101*d* for the outer wall of the hood is interrupted and therefore not present, as shown in FIG. 4A.

In the second region 101*b*, four notches 106 are also formed, which serve to receive connecting walls of the hood, which connect the inner wall and the outer wall of the hood and improve the rigidity of the hood, in the assembled state of the sliding ring 1. In the case of a divisible hood, in which a part of the hood, for example a grinding head tip, can be removed from the rest of the hood, the connecting walls serve as end walls, which separate the space between the inner wall of the hood and the outer wall of the hood against the environment when the seal ring 1 is mounted, thus providing dust protection. With a larger number of notches 106, the number of possibilities for mounting the sliding ring 1 in the hood increases, so that the assembly requires less concentration by the operator. For example, in the case of 16 notches 106, there are theoretically eight possible positions in which the sliding ring 1 can be mounted, the sliding ring being rotated by 45° between the individual positions.

Furthermore, two openings 107 and 108 are formed in the first region 101*a* of the ring 101. These serve to introduce an elastic material or a starting material for an elastic material, which forms the elastic component 11 of the sliding ring, in the method according to the invention for producing the sliding ring or the escape of excess elastic material or starting material during the production process. Of course, the number of these openings can also be larger or smaller.

In addition, twelve vent holes 109 are formed in the ring 101. Some of them are arranged in the openings 105 to the outside air inlet, others outside these openings 105. The vent holes 109 are used for the escape of gas from the elastic material when it is formed or when it is compressed and the entry of gas into the elastic material when it decompresses again after a compression process.

The elements mentioned, i.e. the hood elements 102, the undercuts 103, the reinforcing ribs 104, the openings 105 to the outside air inlet, the notches 106 and the ventilation holes 109, are arranged in the illustrated exemplary embodiment in a manner that is evenly distributed over the circumference of the sliding ring 1, but can in other exemplary embodiments also be unevenly distributed.

The elastic component 11, which can be seen in FIGS. 2 and 3, is a foam 111 made of polyurethane in the illustrated embodiment. Apart from the openings 107 and 108 and the vent holes 109, it is completely surrounded by the hard component 10 and the sliding component 12. As shown in FIG. 3, a foam protrusion 112, which is formed when filling the foam or its starting material into the space between the hard component 10 and the sliding component 12, can be present in one or both of the openings 107 and 108.

In other exemplary embodiments, if the elastic component 11 consists of other materials, such as, for example, a gas, a liquid, a gel or loose solid particles, there are no openings in the hard component 10 from which the material of the elastic component could possibly escape under pressure, or are closed again after filling the material of the elastic component.

The sliding component 12 in the illustrated embodiment consists of a film 121 made of polyethylene. In the area of the reference line of reference numeral 121 in FIG. 2, there is a sliding surface which is provided for sliding on the surface to be machined. The elastic component 11 is arranged on the side of the sliding component 12 opposite the sliding surface. As shown in particular in FIG. 5B, the film 121 overlaps the ring 101 in a lower part of the first area 101*a* and is connected to it by a material connection, which is produced, for example, by means of ultrasonic welding.

Details of the hard component 10 are explained below with reference to FIGS. 4A and 4B, wherein FIG. 4A shows a cross section through the hard component 10 at the location of an opening 105 to the outside air inlet and a ventilation hole 109 and FIG. 4B shows a cross section through the hard component 10 at the location of a hood component 102 and a reinforcing rib 104. The stated widths are measured in each case along the x direction indicated in the figures, and the heights mentioned are each measured along the y direction indicated in the figures, which is perpendicular to the x direction, unless stated otherwise.

The first region 101*a* has a width b1, measured from the inner side facing a grinding element (grinding plate) of the grinding device to an outer side of the sliding ring, and a height h1. In addition, FIG. 4A shows that the first region 101*a* does not run flat but has a slightly curved radius R. This is particularly advantageous in order to absorb the pressure force exerted on the sliding ring. The second region 101*b* has a width b2 on its upper side and a width b3 and a height h2 on its underside, measured from the upper side of the first region 101*a*. The first support surface 101*c* for the inner wall of the hood is formed on the inner side of the second region 101*b*, while the second support surface 101*d* is formed for the outer wall of the hood on the outer side of the second region 101*b*. The upper edges of the second area 101*b* are rounded off for better insertion of the sliding ring 1 into the hood, and a gap 101*e* is formed in the second area 101*b* approximately centrally between the inner side facing the grinding device and an outer side of the second area 101*b* extends from the top of the second region 101*b*. The height of the gap 101*e* varies over the circumference of the ring 101 and is in each case sized such that between the lower edge of the gap 101*e* and an opening 105 to the external air inlet or the underside of the first region 101*a* there is always a material height which ensures that the mechanical stability of the ring 101 is sufficiently high.

The opening 105 to the outside air inlet runs obliquely from the top of the first region 101*a* to the inner side of the ring 101 and is cuboid. In this case, the opening 105 has a height h3, which is measured perpendicularly between an upper side of the opening 105 and a lower side of the opening 105 and thus not along they direction, and a depth, measured in a direction that runs perpendicular to the plane of the drawing. The vent hole 109 is formed in the illustrated case with a circular cross section and extends from the top of the first area 101*a* to the bottom of the first area 101*a*.

The hood element 102 shown in FIG. 4B is connected to the second region 101*b* and extends from just below the upper edge of the second region 101*b* with a height h4, thus extending along the inner side of the second area 101*b*. On its upper side, which is rounded, the hood element 102 has a width b4. Furthermore, in FIG. 4B, the undercut 103 is designed for a hook of the hood in the second area 101*b*. The undercut 103 has a height h6 and a width, which is measured from the inner side of the second region 101*b*, which is sufficiently large for the secure hooking of the hook. The hood element 102 and the undercut 103 extend over a distance which is measured along the inner circumferential line of the sliding ring. As shown in FIG. 4B, the gap 101*e* deepens into a wider area, i.e. it is longer than that shown in FIG. 4A.

The reinforcing rib 104 is essentially triangular and has a height h5 and a width b5 and a thickness, measured in a direction perpendicular to the plane of the drawing, wherein the reinforcing rib is thicker on its side facing the second region 101*b* than on its outside. Between the reinforcing rib 104 and the vertical part of the second section 101*b*, there is a second bearing surface 101*d* and a gap 110, which widens slightly towards the top.

Exemplary dimensions of the individual elements of the sliding ring 1 shown in FIGS. 1 to 4B are shown in Table 1. The dimensions can of course be designed differently for other embodiments of the sliding ring.

TABLE 1

| Element | Reference numbers | Dimensions | Value |
|---|---|---|---|
| Sliding Ring | 1 | Inner Diameter | 234 mm |
| | | Outer Diameter | 286 mm |
| First area of the ring | 101a | Width b1 | 26.5 mm |
| | | Height h1 | 3 mm |
| | | Radius R | 25.56 mm |
| Second area of the ring | 101b | Width b2 | 6 mm |
| | | Width b3 | 9.91 mm |
| | | Height h2 | 10.87 mm |
| First contact surface | 101c | Width | 1.1 mm |
| Second contact surface | 101d | Width | 2.5 mm |
| Gap | 101e | Width | 1 mm |
| Hood Element | 102 | Width b4 | 0.7 mm |
| | | Height h4 | 11.2 mm |
| | | Distance | 39.88 mm |
| Undercut | 103 | Width | 2.3 mm |
| | | Height h6 | 4 mm |
| | | Distance | approx. 30.8 mm |
| Reinforcing Rib | 104 | Width b5 | 16 mm |
| | | Height h5 | 7.6 mm |
| | | Strength | 3 to 4 mm |
| Opening to outside air inlet | 105 | Height h3 | 2 mm |
| | | Depth | 8 mm |
| Opening for the introduction or escape of elastic material | 107, 108 | Diameter | 8 mm |
| Vent Hole | 109 | Diameter | 0.8 mm |

FIG. 5A shows a cross section through a first embodiment of a grinding device 2 according to the invention, the cutting line running through the axis of rotation of a grinding element 20 and an abrasive 21 attached to it. The grinding device 2 corresponds essentially to the structure of the grinding devices known from prior art, but the sliding ring 1 according to the invention is mounted. FIG. 5B shows the edge region of the grinding device 2 in a detailed form.

The grinding device 2 contains a hood 30 which surrounds and covers the grinding element 20. A connection 31 for a connection to a suction device (not shown) is provided on the hood 30, air and grinding dust being sucked out of the interior of the hood 30 via the suction device and at the same time a negative pressure is generated inside the hood 30, as a result of which the grinding device 2 adheres to the surface to be machined. The grinding device also has a motor 40, which drives the grinding element 20 via a gear 50. With a holding device 60, the grinding device 2 can be held manually and moved over the surface to be machined. At the connection 31 for the connection to a suction device, a hose 70 is attached, which can be connected to a suction device, through which air and grinding dust are removed from the hood 30 and into a suction device.

FIG. 5B shows the edge region of the grinding device 2, which is identified as detail D in FIG. 5A with a dashed line. The hood 30 and the sliding ring are shown in a cross section at a point at which the sliding ring is detachably connected to the hood 30 by a hook 331. This cross section corresponds to the section along the line AA through the sliding ring, as shown in FIGS. 1 to 3. This shows the sliding ring with its components, hard component, soft component 11 and sliding component 12. In the cross section shown, the hard component has the first region 101*a* and the second region 101*b* of the ring, a hood element 102, an undercut 103 for a hook and an opening 105 for the external air inlet. In its edge area, the hood 30 has an outer wall 32 and an inner wall 33, between which there is an intermediate space 34. The second region 101*b* of the ring projects into this intermediate space. In the cross section shown, the outer wall 32 of the hood 30 is not seated on the ring of the sliding ring, since at this point, an opening 105 to the external air inlet interrupts the second contact surface of the ring. In other areas of the grinding device, however, the outer wall 32 is seated on the second contact surface of the ring, which, for example, in FIG. 4B is labeled with the reference number 101*d*, the outer wall 32 being arranged between the existing reinforcing ribs, in FIGS. 1, 2 and 4B with the reference number 104, and the second region 101*b* of the ring. The inner wall 33 of the hood 30 is shown in the cross section in FIG. 5B as a hook 331, the lower section 331*a* of which has a widened cross section and projects into the undercut 103. The hook 331 thus creates a secure, releasable connection of the sliding ring to the hood 30.

FIG. 6 shows a perspective view of a divided hood 30 in the upper area of the figure and a perspective view of a second embodiment 1 of the sliding ring, wherein the sliding ring 1 is also divided, in the lower area of the figure. In this context, divided means that the hood 30 consists of a first region 35 and a second region 36 and the sliding ring 1 consists of a first ring segment 13 and a second ring segment 14, which can each be detached from one another. The first region 35 of the hood 30 forms approximately a quarter of the circumference of the hood 30 and the first ring segment 13 forms approximately a quarter of the circumference of the sliding ring 1, while the second area 36 and the second ring segment 14 each represent three quarters of the circumference of the hood 30 and the seal ring 1 respectively. In the assembled state, the first ring segment 13 of the sliding ring 1 is connected to the first region 35 of the hood 30, while the second ring segment 14 of the sliding ring 1 is connected to the second region 36 of the hood 30. In order to better process a surface in an edge region, for example at the transition between a ceiling and a wall or in a corner of the room, the first region 35 of the hood 30 and the first ring segment 13 of the sliding ring 1 can be removed. The remaining second area 36 of the hood 30 and the remaining second ring segment 14 of the sliding ring 1 continue to provide good dust protection and, albeit somewhat reduced, the suction of grinding dust from the inside of the hood when processing a surface. Only the adhesion of the grinding device due to a vacuum cannot be guaranteed with this type of machining.

The first area 35 of the hood 30 has a fastening element 37, for example a hook, which is inserted into a corresponding element of the second area 36 of the hood 30, for example a snap-in recess with a snap-in bridge, and is firmly connected to it, but can be releasable. In addition, the first section 35 of the hood 30 has several positioning elements 38, such as protruding lugs, which correspond to corresponding elements of the second section 36 of the hood 30 and ensure the correct positioning of the first section 35 in relation to the second section 36 during assembly.

The sliding ring 1 and the hood 30 are otherwise of the same design as the first embodiment 1 of the sliding ring described with reference to FIGS. 1 to 5B or as the hood 30 described with reference to FIGS. 5A and 5B. In the illustrated embodiment of the sliding ring 1, five hood elements 102 are formed in the second ring segment 14 and a hood element 102 is formed in the first ring segment 13, each hood element 102 having a means for releasably connecting the sliding ring 1 to the hood 30, for example with a hook as shown in FIG. 5B, identified by reference number 331. Of course, the number of hood elements 102 and thus the means for a releasable connection can also be selected differently, or the hood elements and means for a releasable connection can be different on the first and second ring segments 13, 14 of the sliding ring 1 or they can be arranged in a distributed manner on the first and second areas 35, 36 of the hood 30. For example, six hood elements can be formed in the second ring segment and two hood elements in the first ring segment.

FIG. 7 shows a cross section through a region of another embodiment of a grinding device according to the invention, which has a sliding ring 1" according to a third embodiment. FIG. 8 shows a hood 30" of the grinding device and the sliding ring 1 from FIG. 7 in an exploded view. In the illustrated further embodiment of the grinding device according to the invention, of which only the edge region is shown in the cross section depicted in FIGS. 7 and 8, the sliding ring 1" has the elastic component 11, for example a foam 111, and the sliding component 12, for example, a film 121, but not the hard component 10, as is the case with the first embodiment 1 and the second embodiment 1', which are described with reference to FIGS. 5B and 6 respectively. For this purpose, a hood 30" of this embodiment of the grinding device has an edge region 39 which takes over the function of the hard component. The edge region 39 extends from a lateral region 301 of the hood 30", essentially along a direction that is parallel to the surface to be machined. The edge region 39 preferably extends essentially from the lateral region 301 to the outside, i.e. in a direction opposite to the direction which runs towards the grinding element of the grinding device.

The edge region 39 can be formed in one piece with the other regions of the hood 30", in particular with the lateral region 301, or can be firmly and permanently connected to them. However, it is also possible for the edge area 39 to be detachably connected to the other areas of the hood. For this purpose, the hood can, for example, be designed similarly to the hood 30, which is described with reference to FIGS. 5A and 5B. In particular, the hood or the edge region 39 can have means for releasably connecting the edge region 39 to the hood.

Since the edge region 39 serves as an abutment for the elastic component 11 of the sliding ring 1" when it is elastically deformed, reinforcing ribs similar to the reinforcing ribs 104 described with reference to the first embodiment 1 and the second embodiment 1' of the sliding ring can be arranged in the edge region 39. In addition, at least one opening 302 for the external air inlet can be formed in the hood 30", as is shown in FIGS. 7 and 8. The openings 302 to the outside air inlet are preferably arranged adjacent to or near the edge region 39 in the side region 301 or can even be at least partially formed in the edge region 39, as is shown in FIGS. 7 and 8. However, the openings 302 to the external air inlet can also be arranged at another location on the hood 30", the openings 302 to the external air inlet each extending from an outside of the hood 30" to the inside of the hood 30".

The third embodiment 1" of the sliding ring shown in FIGS. 7 and 8 has, in addition to the elastic component 11 and the sliding component 12, a connecting component 80, which is, for example, a double-sided adhesive tape 801. The connecting component 80 is used to fasten the elastic component 11 and the sliding component 12 connected to it to the edge region 39 of the hood 30", the connection preferably being designed to be detachable, so that when the sliding ring 1" wears, it can be replaced by a new sliding ring 1". The connecting component 80 thus represents a means for releasably connecting the sliding ring 1" to the hood 30" of the grinding device.

In other embodiments of the sliding ring according to the invention, the connecting component is not part of the sliding ring, but is only connected to the sliding ring on the one hand and the edge region 39 of the hood 30" on the other hand when the sliding ring is mounted on the hood 30".

Of course, the hood 30" and the sliding ring 1" can also be supplied in a split form similar to that shown in FIG. 6 described with reference to the split hood 30' and sliding ring 1'. Further embodiments of the hood and the sliding ring, not shown here, can also be designed in a divided form, i.e. consisting of a plurality of at least two regions or ring segments that can be detached from one another.

The number, arrangement and configuration of the various elements of the sliding ring according to the invention and the hood of the grinding device according to the invention are not limited to the illustrated embodiments. Some or all of the elements shown can be combined with one another or provided individually, as long as they are not mutually exclusive.

REFERENCE NUMBERS

1, 1', 1" Sliding ring
10 Hard components
101 Ring
101*a* First area of the ring
101*b* Second area of the ring
101*c* First contact surface (for the inner wall of the hood)
101*d* Second contact surface (for the outer wall of the hood)
101*e* Gap in the second area of the ring
102 Hood element
103 Undercut for the hook
104 Reinforcing rib
105 Opening to the outside air inlet
106 Notch
107 Opening for the introduction of an elastic material
108 Opening for the escape of excess elastic material
109 Vent hole
110 Gap for the outer wall of the hood
11 Elastic component
111 Foam
112 Foam overhang
12 Sliding component
121 Foil
13 First ring segment of the sliding ring
14 Second ring segment of the sliding ring
2 Grinder
20 Grinding element
21 Abrasives
30, 30', 30" Hood
301 Lateral area of the hood
302 Opening to the outside air inlet
31 Connection for a suction device
32 Outer wall of the hood
33 Inner wall of the hood
331 Hook
331*a* Lower section of the hook
34 Space
35 First area of the hood
36 Second area of the hood
37 Fastener
38 Positioning element
39 Edge area of the hood
40 Motor
50 Gears
60 Holding device
70 Tube
80 Connecting component

801 Double-sided tape
b1 Width of the first area of the ring
b2 Width of the second area of the ring
b3 Width of the second area of the ring at the bottom
b4 Width of the hood element at the top
b5 Width of the reinforcing rib
h1 Height of the first area of the ring
h2 Height of the second area of the ring
h3 Height of the opening to the outside air inlet
h4 Height of the hood element
h5 Height of the reinforcing rib
h6 Height of the undercut
R Radius of curvature of the first area of the ring

The invention claimed is:

1. A sliding ring for a grinding device having a grinding element and a hood covering the grinding element, the sliding ring adapted for attaching to a side of the hood facing a surface to be machined, the sliding ring comprising:

a sliding surface for sliding on the surface to be machined;

at least one elastic component and a sliding component;

the sliding surface being formed on the sliding component, and the at least one elastic component being arranged on a side of the sliding component opposite the sliding surface;

wherein the elastic component comprises an elastically deformable material of at least one of a rubber, an elastomer, and a foam;

wherein the sliding component is formed of a sliding material of polyethylene (PE), polytetrafluoroethylene (PTFE), polyolefin, graphite, polypropylene (PP) or polyamide (PA); and wherein the at least one elastic component is completely enclosed by one of: a) the sliding component; or b) the sliding component and a hard component.

2. The sliding ring according to claim 1, wherein the at least one elastic component is arranged between the sliding component and the hard component.

3. The sliding ring according to claim 2, wherein the hard component is a rigid plastic ring, the at least one elastic component is an annular layer of a polyurethane foam, and the sliding component is a polyethylene film, and wherein the hard component and the sliding component completely enclose the elastic component.

4. The sliding ring according to claim 2, wherein openings for passage of air into the interior of the sliding ring are arranged in the hard component.

5. The slip ring according to claim 2, wherein the hard component includes a first region extending essentially parallel to the surface to be machined, and a second region relatively perpendicular to the first region, the second region extending vertically from the first region and having one or more undercuts adapted to attach to a portion of the hood.

6. The slip ring according to claim 5, wherein the first region has a width greater than a width of the second region.

7. The slip ring according to claim 5, wherein the first region extending essentially parallel to the surface to be machined includes a curved radius for absorbing a pressure force exerted on the ring.

8. The sliding ring according to claim 1, wherein the sliding component is one of: a) a region of the surface of the at least one elastic component which is changed relative to a base material of the at least one elastic component; orb) a coating of the at least one elastic component with a slidable material or a slidable film or a plurality of small, non-deformable elements made of a slidable material.

9. The sliding ring according to claim 1, wherein the at least one elastic component is an annular layer made of a polyurethane foam, and/or the sliding component is a polyethylene film.

10. The sliding ring according to claim 1, further comprising a means for forming part of a detachable connection of the sliding ring to a hood of a grinding device.

11. The sliding ring according to claim 1, wherein the sliding ring has at least two ring segments which are independent of one another or releasably connected to one another.

12. A grinding device comprising:

a grinding element;

a hood covering the grinding element; and a sliding ring arranged on a side of the hood facing a surface to be machined, wherein the sliding ring has a sliding surface for sliding on the surface to be machined, and wherein the sliding ring comprises at least one elastic component and a sliding component, the sliding surface being formed on the sliding component, and the elastic component being arranged on the side of the sliding component opposite the sliding surface; and wherein the at least one elastic component is completely enclosed by one of: a) the sliding component; or b) the sliding component and a hard component.

13. The grinding device according to claim 12, wherein the hood has a first area which includes a part of the periphery of the side facing a surface to be machined, and is detachable from other areas of the hood, wherein a first ring segment of the sliding ring is arranged at the first area, and wherein the length of the first area of the hood and the length of the ring segment arranged in the first area are equal.

14. The grinding device according to claim 13, further comprising a second ring segment of the sliding ring connected to said other areas of the hood, wherein the first ring segment forms one quarter of the circumference of the sliding ring, and the second ring segment forms three quarters of the circumference of the sliding ring.

15. The grinding device according to claim 12, wherein a portion of the sliding surface formed on the sliding component extends essentially parallel to the surface to be machined and beyond a perimeter of the hood to which the sliding ring is attached.

16. The grinding device according to claim 12, wherein the at least one elastic component is arranged between the sliding component and the hard component, and wherein the hard component includes a first region extending essentially parallel to the surface to be machined, and a second region relatively perpendicular to the first region, the second region extending vertically from the first region and having one or more undercuts adapted to attach to the hood.

* * * * *